US010627060B1

(12) United States Patent
Moon et al.

(10) Patent No.: US 10,627,060 B1
(45) Date of Patent: Apr. 21, 2020

(54) QUICK-INSTALLATION LAMP WITH LAMP BODY ASSEMBLY, MOUNT BASE AND WALL PANEL

(71) Applicant: Sang Pil Moon, Seoul (KR)

(72) Inventors: Dai Sung Moon, Seoul (KR); Sang Pil Moon, Seoul (KR)

(73) Assignee: Sang Pil Moon, Seoul (KR)

( * ) Notice: Subject to any disclaimer, the term of this patent is extended or adjusted under 35 U.S.C. 154(b) by 0 days.

(21) Appl. No.: 16/257,101

(22) Filed: Jan. 25, 2019

(30) Foreign Application Priority Data

Nov. 9, 2018 (CN) ..... 2018 2 1857799 U

(51) Int. Cl.

| | |
|---|---|
| ***F21S 8/08*** | (2006.01) |
| ***F21V 21/116*** | (2006.01) |
| ***F21V 21/34*** | (2006.01) |
| ***F21S 8/02*** | (2006.01) |
| *F21V 15/01* | (2006.01) |

(52) U.S. Cl.
CPC ..... *F21S 8/086* (2013.01); *F21S 8/024* (2013.01); *F21S 8/081* (2013.01); *F21V 21/116* (2013.01); *F21V 21/34* (2013.01); *F21V 15/01* (2013.01)

(58) Field of Classification Search
CPC . F21V 21/116; F21S 8/00; F21S 8/003; F21S 8/006; F21S 8/02; F21S 8/022; F21S 8/024; F21S 8/026; F21S 8/028; F21S 8/03; F21S 8/031; F21S 8/032; F21S 8/033; F21S 8/035; F21S 8/036; F21S 8/037; F21S 8/038; F21S 8/04; F21S 8/043; F21S 8/046; F21S 8/06; F21S 8/061; F21S 8/063; F21S 8/065; F21S 8/066; F21S 8/068; F21S 8/08; F21S 8/081; F21S 8/083; F21S 8/085; F21S 8/086; F21S 8/088
See application file for complete search history.

(56) References Cited

U.S. PATENT DOCUMENTS

| | | | | |
|---|---|---|---|---|
| 5,217,296 | A * | 6/1993 | Tanner | F21S 8/00 136/291 |
| 5,258,899 | A * | 11/1993 | Chen | F21S 8/033 362/394 |
| 5,381,323 | A * | 1/1995 | Osteen | F21S 8/033 340/567 |
| 6,100,803 | A * | 8/2000 | Chang | F21V 21/30 250/221 |
| 8,920,005 | B2 * | 12/2014 | Ahn | F21V 31/005 362/373 |
| 2006/0187656 | A1 * | 8/2006 | Kuelbs | F21S 9/035 362/183 |

* cited by examiner

*Primary Examiner* — Robert J May

(57) ABSTRACT

A quick-installation lamp comprises a lamp body assembly, a mount base and a wall panel connected in sequence. The lamp body assembly comprises a lamp body and a lampholder fixedly connected with the lamp body and the mount base respectively. The mount base comprises a base shell having a concave cavity, a mount support integrally formed outside the base shell, a sensing head threadedly connected to the bottom of the mount support, and, a PCB board, a PCB cover, a rubber pad for pins, a terminal block, and a rear cap for the mount base, which are overlappedly mounted in the cavity of the base shell in sequence, and, further comprises pins protruding from the PCB board and respectively passing through through-holes of the PCB cover, through-holes of rubber pad for pins, and through-holes of terminal block. The wall panel comprises two bolts and one linear wall panel.

3 Claims, 2 Drawing Sheets

QUICK-INSTALLATION LAMP WITH LAMP BODY ASSEMBLY, MOUNT BASE AND WALL PANEL

CROSS-REFERENCE TO PRIOR APPLICATION

This application claims the benefit of Chinese Patent Application No. 201821857799.6 filed on Nov. 9, 2018, the contents of which are incorporated herein by reference.

FIELD OF THE INVENTION

The present invention relates to outdoor lamps, more particularly to a quick-installation lamp.

BACKGROUND OF THE INVENTION

During the installation of conventional outdoor lamps, usually it is necessary to directly connect the electric wires pre-positioned at the rear part of the mount base of the lamp and the electric wires pre-positioned in the junction box at user's home by wire caps. In this case, since two hands of installation personnel are busy for the connection of the electric wires, the unfixed lamp will hang in the air during such connection of the electric wires. Hence, the lamps are inconvenient to install.

SUMMARY OF THE INVENTION

The present invention aims to provide a quick-installation lamp which comprises a lamp body, a mount base and a wall panel when it goes out from the factory, and the three parts can be quickly assembled in this sequence, which can solve the problem that the lamp is unfixed during the connection of the electric wires.

In order to solve the above problem, the present invention provides a quick-installation lamp, characterized in that it comprises a lamp body assembly, a mount base and a wall panel which are connected in this sequence.

Preferably, the lamp body assembly comprises a lamp body and a lampholder fixedly connected with the lamp body and the mount base respectively.

Preferably, the lamp body comprises a lamp shell, and, an aluminum substrate, a reflector, a first waterproof ring, a lampshade and a surface cover which are overlappedly arranged in this sequence at the opening part of the lamp shell.

Preferably, the lampholder comprises a rotating arm fixedly arranged on the lamp shell in a manner of being isolated by a second waterproof ring, a sleeve connected at the side of the rotating arm by a threaded connection by means of a screw, a rotating shaft molded to extend perpendicular to the sleeve, a rubber ring connected, by a threaded connection, with a further screw inserted at the center of the circular opening of the rotating shaft, a flat gasket, and an end cap disposed at the top of the further screw.

Preferably, the mount base comprises a base shell having a concave cavity, a mount support integrally formed outside the base shell and extending to allow the lamp body assembly to be connected at the top of the mount support, a sensing head connected to the bottom of the mount support by a threaded connection, and, a PCB board, a PCB cover, a rubber pad for pins, a terminal block, and a rear cap for the mount base, which are overlappedly mounted in the cavity of the base shell in this sequence, and, it further comprises pins protruding from the PCB board and respectively passing through through-holes of the PCB cover, through-holes of rubber pad for pins, and through-holes of terminal block.

Preferably, the wall panel comprises two bolts, one linear wall panel, and an EVA pad attached to the rear cap for the mount base.

Compared with the existing devices in the art, the present invention has advantages as follows:

(i) In the present invention, due to the EVA pad which can be sandwichedly arranged between the rear cap for the mount base and the wall, it provides waterproof function.

(ii) In the present invention, since the pins disposed on the PCB board are inserted into the terminal block, an electrical connection is established at the same time.

Figure 1:
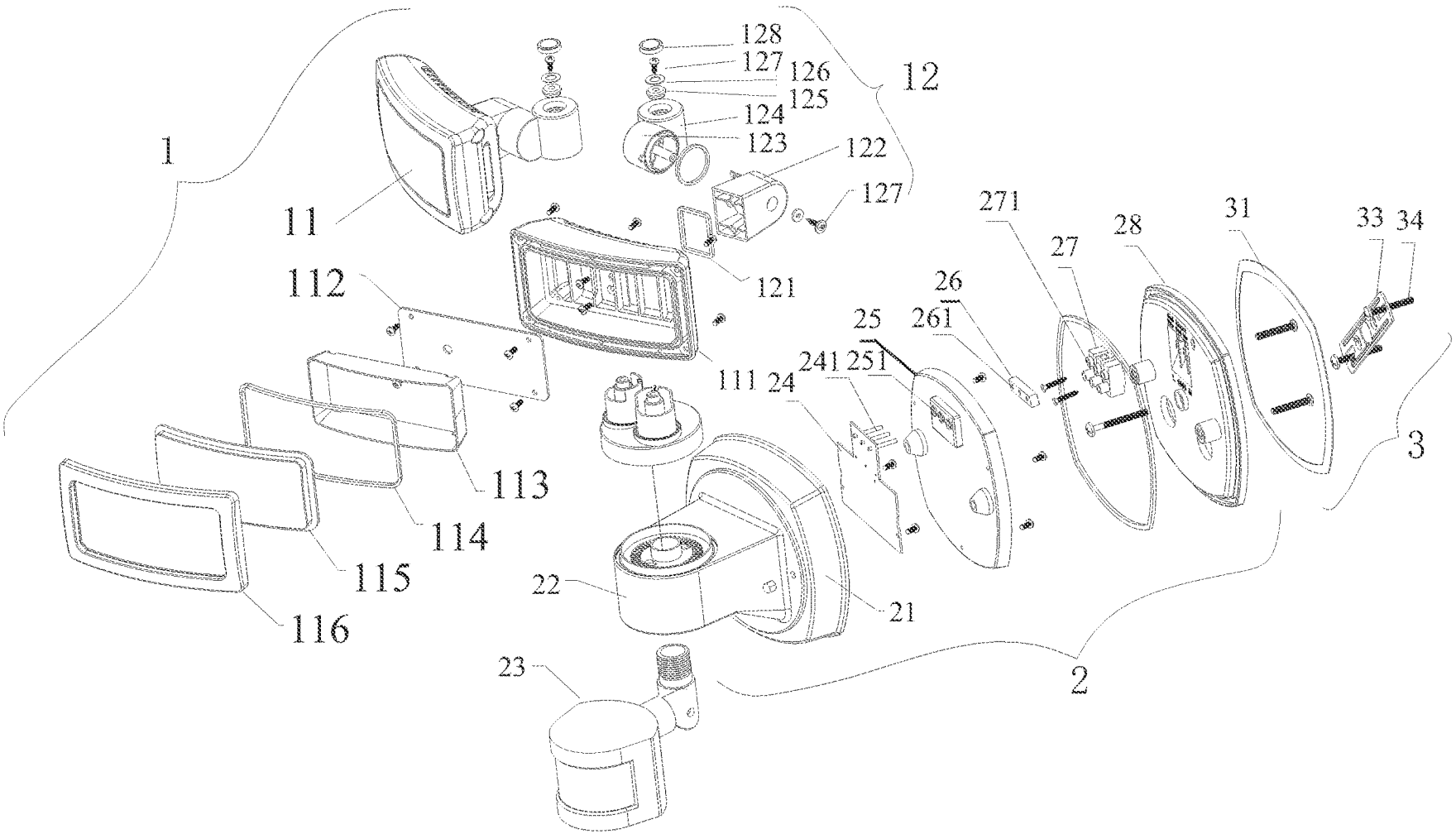
FIG. 1 is an exploded view of a quick-installation lamp according to the present invention.

Reference numerals of main parts are listed as follows.

lamp body assembly 1
lamp body 11
lamp shell 111
aluminum substrate 112
reflector 113
first waterproof ring 114
lampshade 115
surface cover 116
lampholder 12
second waterproof ring 121
rotating arm 122
sleeve 123
rotating shaft 124
rubber ring 125
flat gasket 126
screws 127
end cap 128
mount base 2
base shell 21
mount support 22
sensing head 23
PCB board 24
pins 241
PCB cover 25
through-holes 251
rubber pad for pins 26
through-holes of rubber pad 261
terminal block 27
through-holes of terminal block 271
wall panel 3
EVA pad 31
threaded connecting portion 32
linear wall panel 33
bolts 34

DETAILED DESCRIPTION OF ILLUSTRATED EMBODIMENTS

The present invention will be further explained below in detail in conjunction with drawings.

Figure 4:
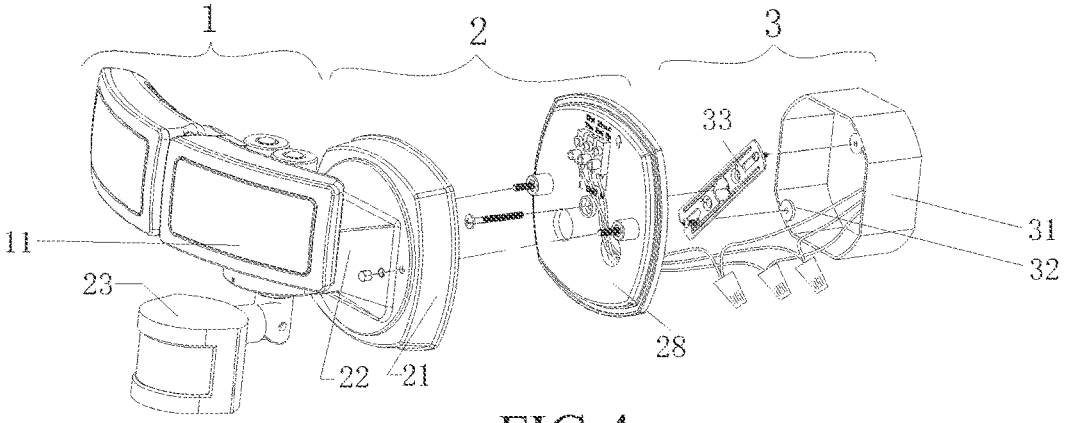
FIG. 4 is a schematic drawing illustrating the structures and arrangements of a lamp body assembly, a mount base and a wall panel according to a quick-installation lamp of the present invention.

Referring to FIG. 4, a quick-installation lamp comprises a lamp body assembly 1, a mount base 2 and a wall panel 3 which are connected in this sequence.

Figure 2:
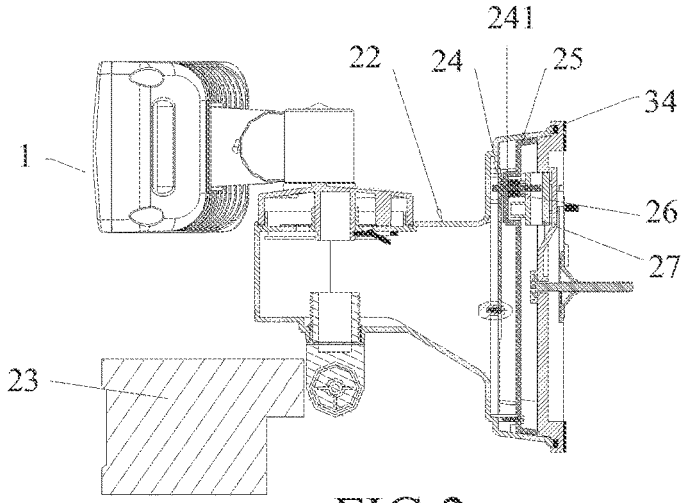
FIG. 2 is a sectional view illustrating a lamp body assembly being connected with a mount base, according to a quick-installation lamp of the present invention.

Referring to FIGS. 1 and 2, the lamp body assembly 1 comprises a lamp body 11 and a lampholder 12 which is fixedly connected with the lamp body 11 and the mount base 2, respectively. The lamp body 11 comprises a lamp shell 111, and, an aluminum substrate 112, a reflector 113, a first waterproof ring 114, a lampshade 115 and a surface cover 116 which are overlappedly arranged in this sequence at the opening part of the lamp shell 111. The lampholder 12 comprises a rotating arm 122 fixedly arranged on the lamp shell 111 in a manner of being isolated by a second waterproof ring 121, a sleeve 123 connected at the side of the rotating arm 122 by a threaded connection by means of a screw 127, a rotating shaft 124 molded to extend perpendicular to the sleeve 123, a rubber ring 125 connected, by a threaded connection, with a further screw inserted at the center of the circular opening of the rotating shaft 124, a flat gasket 126, and an end cap 128 disposed at the top of the further screw 127.

Figure 3:
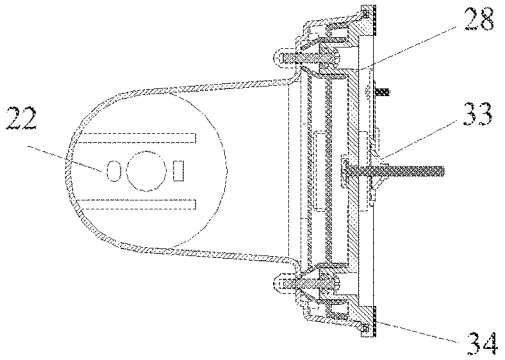
FIG. 3 is a sectional view illustrating a mount base being connected with a wall panel, according to a quick-installation lamp of the present invention.

Referring to FIGS. 2 and 3, the mount base 2 comprises a base shell 21 having a concave cavity, a mount support 22 integrally formed outside the base shell 21, and a sensing head 23 connected to the bottom of the mount support 22 by a threaded connection. Herein, the lamp body assembly 1 is fixedly connected to the top of the mount support 22. The mount base 2 further comprises a PCB board 24, a PCB cover 25, a rubber pad 26 for pins, a terminal block 27 and a rear cap 28 for the mount base, which are overlappedly mounted in the cavity of the base shell 21 in this sequence. The mount base 2 further comprises pins 241 protruding from the PCB board 24 and respectively passing through through-holes 251 of the PCB cover, through-holes 261 of rubber pad for pins, and through-holes 271 of terminal block.

Referring to FIGS. 3 and 4, the wall panel 3 comprises two bolts 34, one linear wall panel 33, and an EVA pad 31 attached to the rear cap 28 for the mount base.

All the above are merely preferred embodiments of the present invention. The present invention is intended to cover all changes and equivalent arrangements included within the scope of the present invention.

The invention claimed is:

1. A quick-installation lamp, comprising a lamp body assembly, a mount base and a wall panel which are connected in this sequence;

the lamp body assembly comprises a lamp body and a lampholder fixedly connected with the lamp body and the mount base respectively;

the lamp body comprises a lamp shell and comprises an aluminum substrate, a reflector, a first waterproof ring, a lampshade and a surface cover which are overlappedly arranged in this sequence at an opening part of the lamp shell;

wherein the lampholder comprises a rotating arm fixedly arranged on the lamp shell in a manner of being isolated by a second waterproof ring, a sleeve connected at a side of the rotating arm by a threaded connection by means of a screw, a rotating shaft molded to extend perpendicular to the sleeve, a rubber ring connected by a threaded connection with a further screw inserted at a center of a circular opening of the rotating shaft, a flat gasket, and an end cap disposed at top of the further screw.

2. The quick-installation lamp according to claim 1, characterized in that the wall panel comprises two bolts and one linear wall panel.

3. A quick-installation lamp, comprising a lamp body assembly, a mount base and a wall panel which are connected in this sequence, wherein the mount base comprises a base shell having a concave cavity, a mount support integrally formed outside the base shell and extending to allow the lamp body assembly to be connected at top of the mount support, a sensing head connected to a bottom of the mount support by a threaded connection, and further comprises a PCB board, a PCB cover, a rubber pad for a pin, a terminal block, and a rear cap for the mount base, which are overlappedly mounted in the cavity of the base shell in this sequence, and further comprises a pin protruding from the PCB board and passing through a through-hole of the PCB cover, a through hole of the rubber pad for the pin, and a through hole of the terminal block, respectively.

* * * * *